US006193185B1

(12) United States Patent
Kim

(10) Patent No.: US 6,193,185 B1
(45) Date of Patent: Feb. 27, 2001

(54) AUTOMATIC STEEL CORD WINDERS

(75) Inventor: Seong-Geol Kim, Ulsan (KR)

(73) Assignee: Hongduk Engineering Co., Ltd., Busan (KR)

( * ) Notice: Subject to any disclaimer, the term of this patent is extended or adjusted under 35 U.S.C. 154(b) by 0 days.

(21) Appl. No.: 09/340,024

(22) Filed: Jun. 28, 1999

(30) Foreign Application Priority Data

Dec. 7, 1998 (KR) ..... 98-53348

(51) Int. Cl.[7] ..... B65H 54/22

(52) U.S. Cl. ..... 242/473.5; 242/473.8; 242/474.8; 242/487.8; 242/533.7

(58) Field of Search ..... 242/473.5, 473.8, 242/474.8, 487.8, 533.7

(56) References Cited

U.S. PATENT DOCUMENTS 2,194,248 * 3/1940 Saul ..... 242/474.8
2,984,425 * 5/1961 Thayer ..... 242/473.5 X
4,390,138 * 6/1983 Rohde et al. ..... 242/533.7 X
4,637,564 * 1/1987 Hallenbeck et al. ..... 242/473.5
6,047,916 * 4/2000 Onnerlov ..... 242/533.7 X

* cited by examiner

*Primary Examiner*—Donald P. Walsh
*Assistant Examiner*—Minh-Chau Pham
(74) *Attorney, Agent, or Firm*—Bacon & Thomas, PLLC

(57) ABSTRACT

An automatic cord winder for steel cord braiding machines is disclosed. The winder automatically and continuously drives a spool assembly during a steel cord winding operation. In the spool assembly, a plurality of spools are assembled together into a longitudinal single assembly with a side plate siding each end of the assembly. A spool inlet channel and a spool outlet opening are formed on a winder body. A bobbin lift, movably set in the winder body, is selectively raised upwardly along with the spool assembly from an interior position of the body by a lead screw, thus discharging the spool assembly from the body to a designated position above the top wall of the body through the spool outlet opening. Head and tail stocks, individually having a movable cylinder, are positioned on the top wall of the winder body at positions around the spool outlet opening and selectively rotate the spool assembly while holding the assembly. A cord cutter melts the steel cord to cut the cord using an electrode bar when the cord is completely wound around the spools of the spool assembly.

4 Claims, 7 Drawing Sheets

AUTOMATIC STEEL CORD WINDERS

BACKGROUND OF THE INVENTION

1. Field of the Invention

The present invention relates, in general, to a steel cord winder used for winding a steel cord from a steel cord braiding machine around a spool and, more particularly, to an automatic steel cord winder, designed to automatically and continuously drive a spool assembly, consisting of a plurality of spools, while feeding the spool assembly into the winder body, moving the assembly to a designated position between the head and tail stocks of the winder body, setting the spool assembly at the designated position, sequentially winding the steel cord around the spools of the assembly, and dispensing the spool assembly from the winder body when the spools are completely filled with the steel cord.

2. Description of the Prior Art

As well known to those skilled in the art, steel cords are widely and effectively used as reinforcements for rubber products, such as wheel tires and conveyor belts. In the prior art, the steel cords are produced as follows. That is, a carbon steel wire rod emanating from pre-processes, such as a scale removing process and a patenting heat treatment process, is plated with brass, thus having an improved adhesiveness for rubber. The brass-plated wire rod is, thereafter, stepwisely drawn by a wire draw bench until the wire rod becomes a brass-plated, drawn wire having a desired diameter. A plurality of wires from the wire drawing process are twisted together at a predetermined pitch by a cord braiding machine, thus forming a desired steel cord. The steel cord is, thereafter, wound around a spool by a cord winder.

A conventional cord winder, used for winding the steel cord from the cord braiding machine around a spool, comprises a movable guider which is operated by a lead screw to reciprocate within a predetermined range while guiding the steel cord from the braiding machine to a spool, thus allowing the cord to be evenly wound around the spool. The cord winder also has two stocks, a head stock and a tail stock. The two stocks rotate the spool while holding both ends of the spool during a cord winding operation of the winder. The movable guider and the two stocks are held on a winder body.

In the conventional cord winder, only one spool is installed at a designated position between the two stocks, and so the winder is problematic in that it forces a worker to always stand in the vicinity of the winder and to regrettably consume labor and time while changing a full spool with an empty spool.

In addition, since the spool is standardized and is rotated at a high speed, it is necessary for a worker to frequently check the cord winding operation of the spool in addition to the frequent change of spools. This forces the worker to grow tired of managing the cord winder and limits the number of winders effectively managed by a worker.

In an operation of the conventional winder, it is also necessary to stop the braiding machine every time a full spool is changed with an empty spool. The cord winder thus fails to achieve a continuous operation of the braiding machine and results in a reduction in productivity while producing and winding the steel cords.

In an effort to overcome the above problems, a multi-spool cord winder, in which a multi-spool, consisting of three or more spools, is installed at a designated position between the head and tail stocks and sequentially winds the steel cord on the three spools, is proposed and used. Such a multi-spool cord winder somewhat lengthens the interval of changing the spools.

However, the multi-spool cord winder is also problematic in that it requires a worker to stand in the vicinity of the winder during an operation of the winder so as to change the multi-spools. In a brief description, the conventional cord winders for steel cord braiding machines are designed so that a changing of a full spool with an empty spool is performed manually, thus forcing a worker to always stand in the vicinity of the cord winder and to frequently change the spools during an operation of the winder.

SUMMARY OF THE INVENTION

Accordingly, the present invention has been made keeping in mind the above problems occurring in the prior art, and an object of the present invention is to provide an automatic cord winder for steel cord braiding machines, which is designed to automatically and continuously drive a spool assembly, consisting of a plurality of spools, while feeding the spool assembly into a winder body, moving the spool assembly to a designated position between the head and tail stocks on the winder body, setting the spool assembly at the designated position, sequentially winding the steel cord around the spools of the assembly, and dispensing the spool assembly from the winder body when the spools are filled with the steel cord.

In order to accomplish the above object, the present invention provides an automatic steel cord winder, comprising: a spool assembly consisting of a plurality of spools, the spools being assembled together into a longitudinal single assembly with both an intermediate plate interposed at each junction between the spools and a side plate siding each end of the spool assembly, the spool assembly being used for winding a steel cord on the spools; a winder body having both a spool inlet channel and a spool outlet opening, the spool inlet channel extending from a spool inlet opening, formed on a front wall of the body, to an interior position of the body and adapted for allowing the spool assembly to be fed from the spool inlet opening into the interior position of the body, the spool outlet opening being formed on a top wall of the body and adapted for allowing the spool assembly to be discharged upwardly from the interior position of the body to a designated position above the top wall of the body; a bobbin lift movably set in the winder body and selectively raised upwardly along with the spool assembly from the interior position of the body by a lead screw, thus discharging the spool assembly from the body to the designated position above the top wall of the body through the spool outlet opening; head and tail stocks respectively positioned on the top wall of the winder body at positions around both edges of the spool outlet opening, each of the stocks having a movable cylinder, the cylinder selectively engaging with each side plate of the spool assembly, placed on the designated position above the spool outlet opening, and rotating the spool assembly while holding the assembly; and a cord cutter adapted for melting the steel cord to cut the cord using an electrode bar, with the cord completely wound around the spools of the spool assembly under the guide of a reciprocating guide roller.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
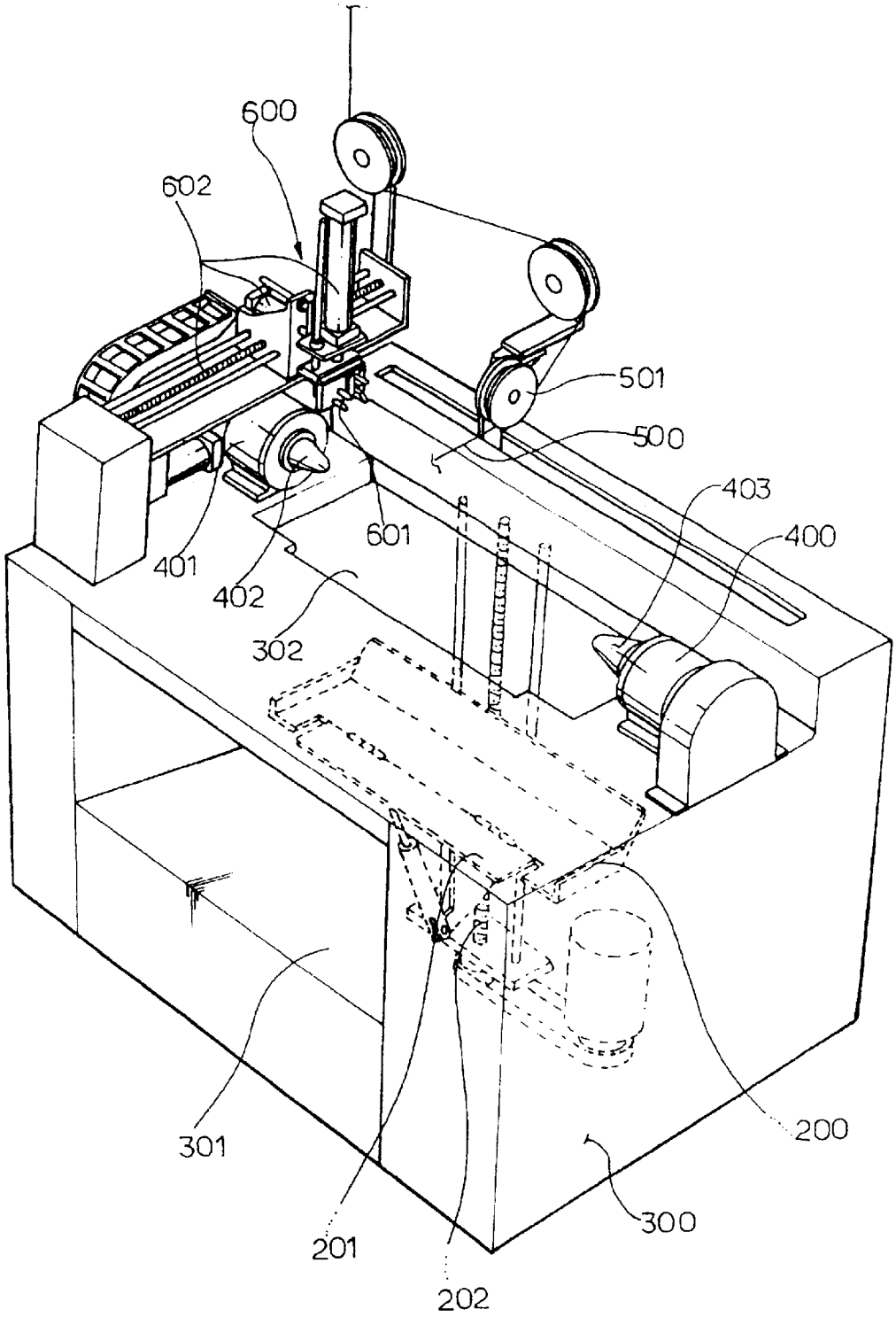
FIG. 1 is a perspective view of an automatic steel cord winder in accordance with the preferred embodiment of the present invention.
Figure 2A:
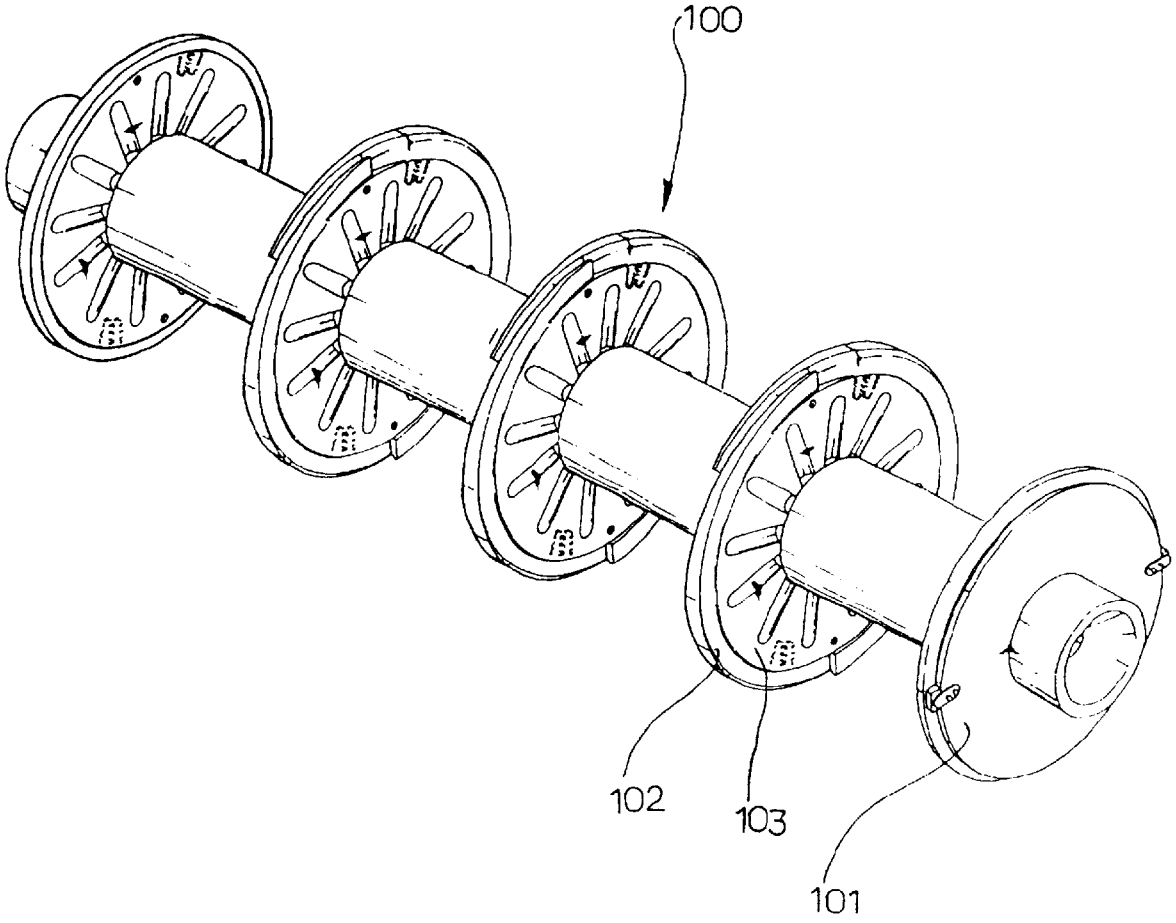
FIG. 2*a* is a perspective view of a spool assembly specifically designed to be used with the steel cord winder of this invention.
Figure 2B:
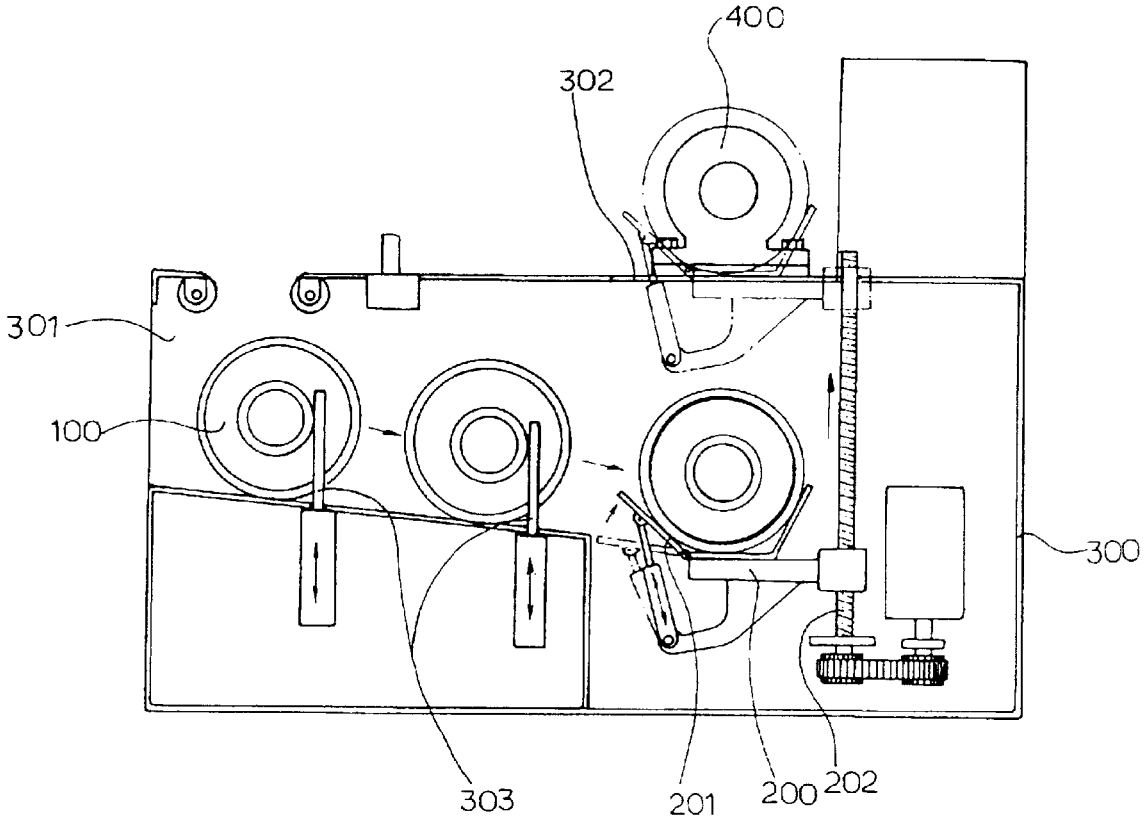
FIG. 2*b* is a side sectional view of the steel cord winder of this invention, showing a plurality of spool assemblies fed into the winder body in order.
Figure 2C:
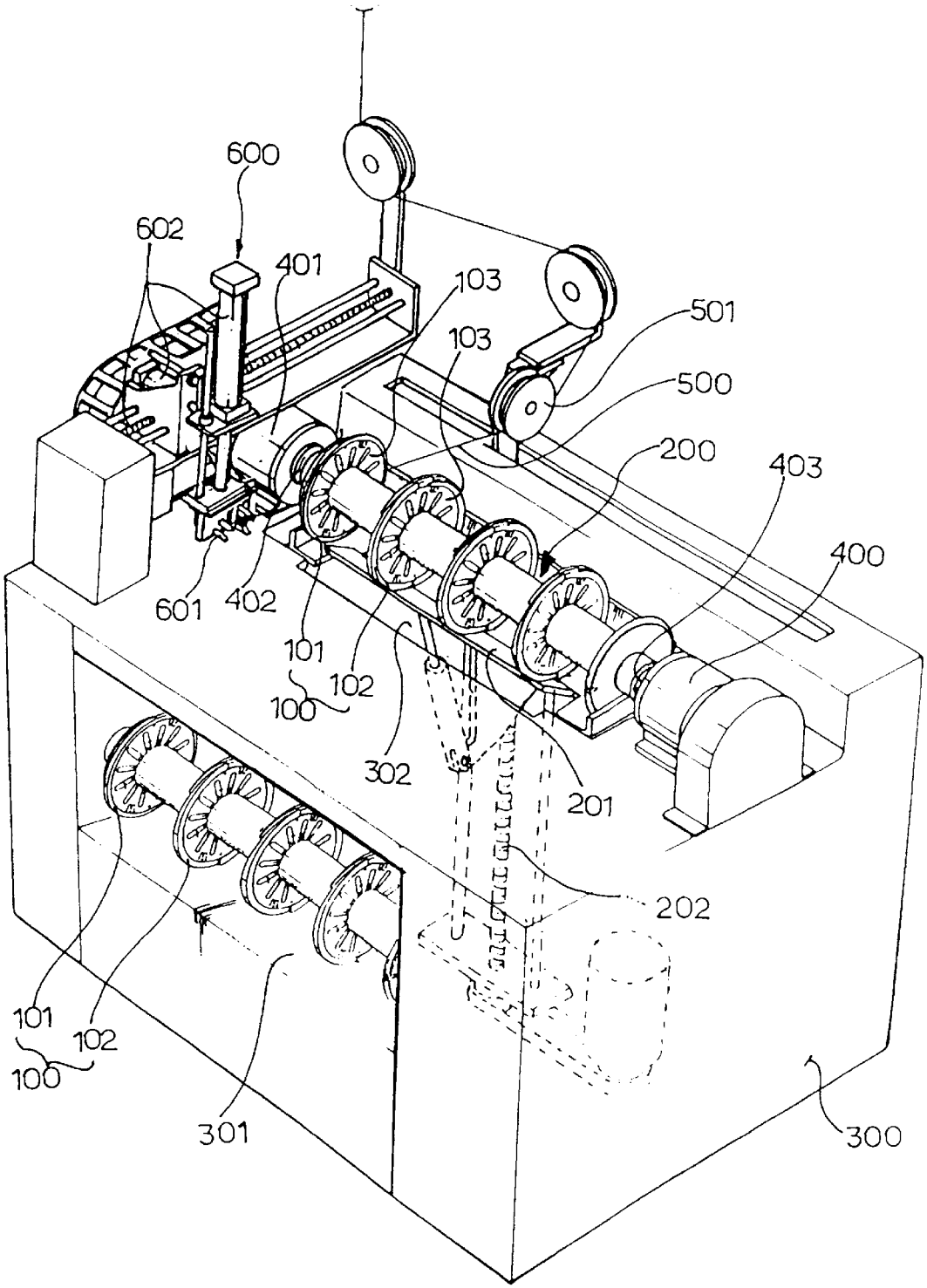
FIG. 2*c* is a perspective view of the steel cord winder of this invention, showing a spool assembly installed at a designated position on the winder body.
Figure 2D:
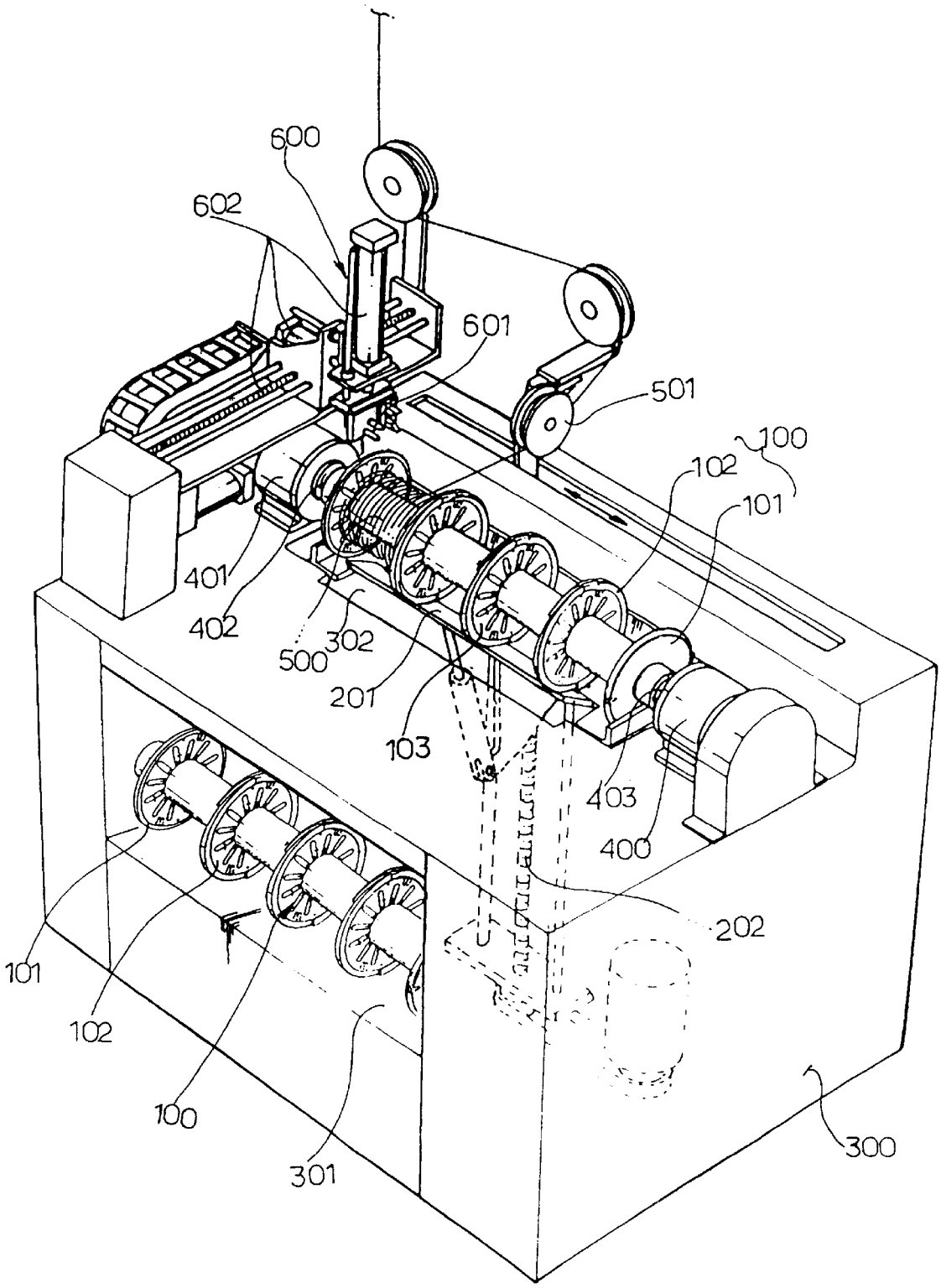
FIG. 2*d* is a perspective view of the steel cord winder of this invention, showing a steel cord sequentially wound around the spools of the spool assembly installed at the designated position on the winder body.
Figure 2E:
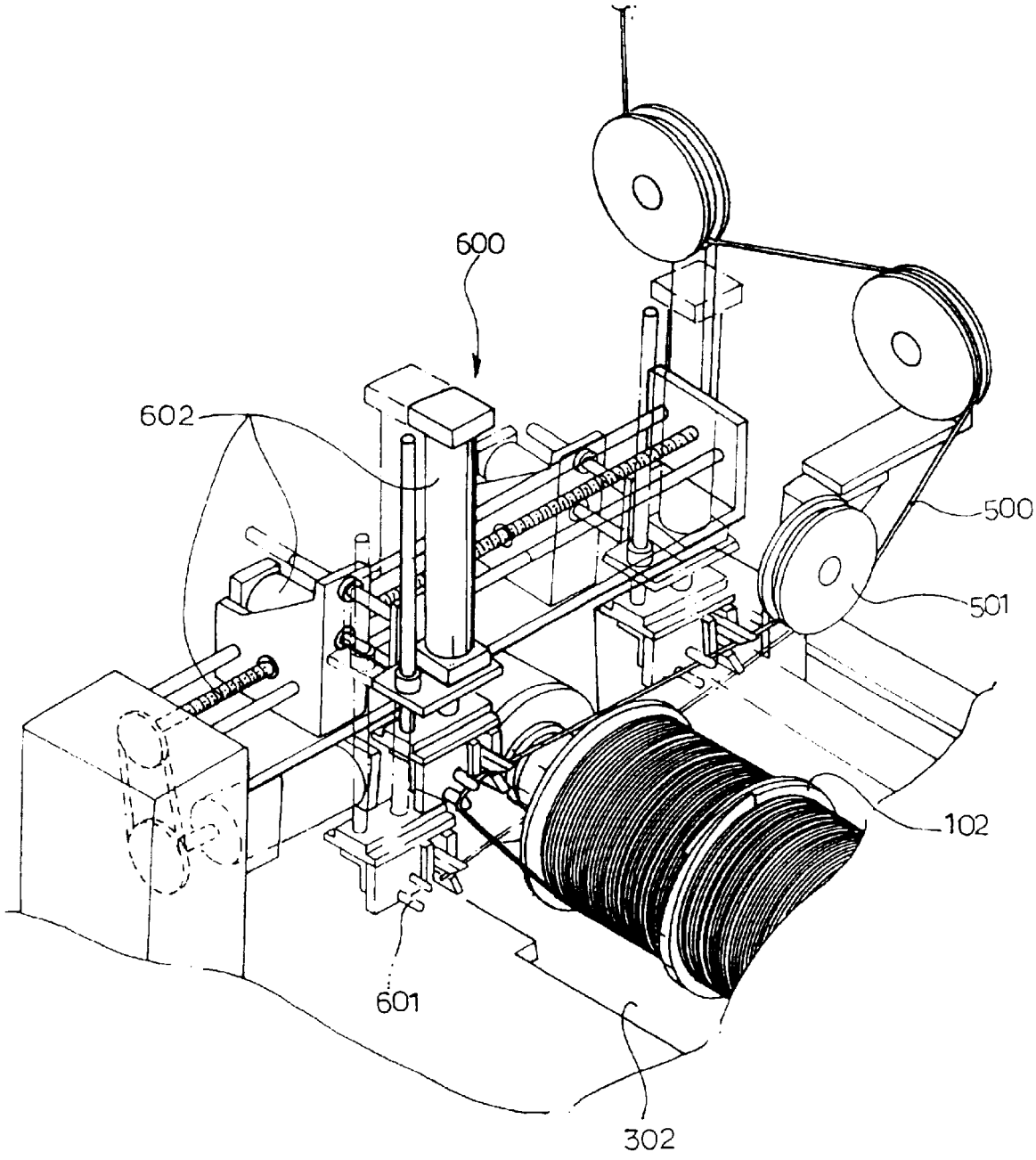
FIG. 2*e* is a perspective view of a part of the steel cord winder of this invention, showing the steel cord completely wound around the spools of the spool assembly and cut by a cord cutter.
Figure 2F:
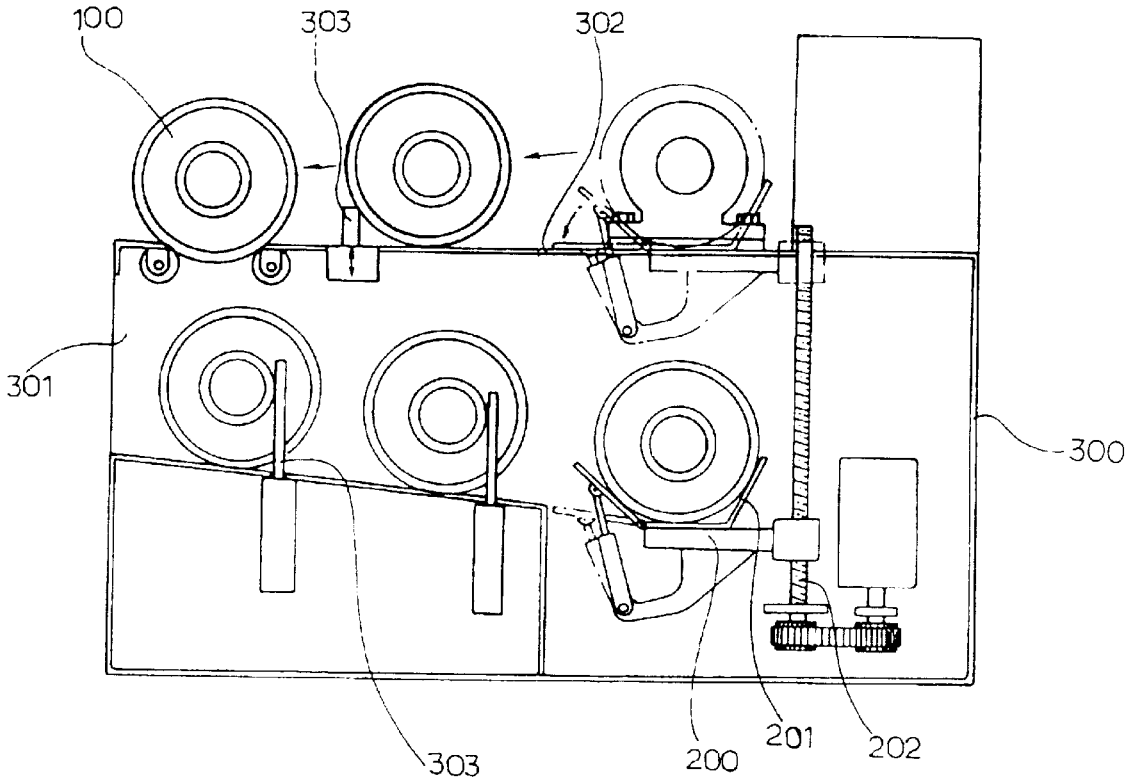
FIG. 2*f* is a side sectional view of the steel cord winder of this invention, showing the spool assembly filled with the steel cord and dispensed from the winder body.

FIG. 1 shows the construction of an automatic steel cord winder in accordance with the preferred embodiment of this invention. FIG. 2*a* shows a spool assembly specifically designed to be used with the steel cord winder of this invention. FIGS. 2*b* to 2*f* show the operation of the above steel cord winder. Of FIGS. 2*b* to 2*f*, FIG. 2*b* shows a plurality of spool assemblies fed into the winder body. FIG. 2*c* shows the spool assembly installed at a designated position on the winder body. FIG. 2*d* shows a steel cord sequentially wound around the spools of a spool assembly installed on the winder body. FIG. 2*e* shows the steel cord completely wound around the spools of the spool assembly and cut by a cord cutter. FIG. 2*f* shows the spool assembly filled with the steel cord and dispensed from the winder body.

As shown in the drawings, the steel cord winder of this invention uses a specifically designed spool assembly 100 around which a steel cord 500 is wound. In order to produce the spool assembly 100, a plurality of spools 103 are assembled together into a single assembly with an intermediate plate 102 interposed at each junction between the spools 103 as shown in FIG. 2*a*. Each end of the spool assembly 100 is sided by a side plate 101. The steel cord winder of this invention comprises a winder body 300, a bobbin lift 200, head and tail stocks 401 and 400, and a cord cutter 600. The winder body 300 has a spool inlet channel 301 extending from a spool inlet opening, formed on the front wall of the body 300, to a position inside the body 300. The winder body 300 also has a spool outlet opening 302 at its top wall. The spool inlet channel 301 allows a spool assembly 100 to be fed to the interior position of the body 300. On the other hand, the spool outlet opening 302 allows the spool assembly 100 to be discharged upwardly from the interior position of the body 300 to a designated position above the top wall of the body 300. The bobbin lift 200 is raised upwardly along with the spool assembly 100, which is fed into the body 300 through the spool inlet channel 301 and is seated on a spool seat 201 provided at the inside end of the channel 301, by a lead screw 202, thus discharging the spool assembly 100 from the body 300 to the designated position above the top wall of the body 300 through the spool outlet opening 302. The head and tail stocks 401 and 400 are positioned on the top wall of the body 300 at positions around both edges of the spool outlet opening 302. The two stocks 401 and 400 individually have a movable cylinder 402, 403. The two cylinders 402 and 403 selectively engage with the center of both side plates 101 of the spool assembly 100, positioned at the designated position outside the spool outlet opening 302 of the body 300, and rotate the assembly 100 while holding the assembly 100. The cord cutter 600 melts the steel cord 500 to cut the cord 500 using an electrode bar 601 when the cord 500 is completely wound around the spools of the spool assembly 100 under the guide of a reciprocating guide roller 501.

The bottom wall of the spool inlet channel 301 is inclined downwardly in a direction from the spool inlet opening of the body 300 to the spool seat 201, thus allowing a spool assembly 100 to roll down on the bottom wall of the channel 301 prior to being seated on the spool seat 201 of the bobbin lift 200. When a plurality of spool assemblies 100 are fed into the body 300 through the channel 301 in order, the remaining assemblies 100 except for a leading assembly 100 are temporarily held on the inclined bottom wall of the channel 301 at standby positions by a plurality of stoppers 303 as shown in FIG. 2*b*.

In the present invention, the spool inlet opening of the channel 301 and the spool outlet opening 302 have a rectangular profile suitable for allowing the longitudinal spool assembly 100 to be fed into and discharged from the body 300 while retaining its horizontal position.

The above winder is operated to wind a steel cord 500 around the spools of a spool assembly 100 as follows.

In order to produce a spool assembly 100, a plurality of, for example, four empty spools 103 are assembled together into a longitudinal single assembly with an intermediate plate 102 or a connection means interposed at each junction between the spools 103 as shown in FIG. 2*a*. Each end of the spool assembly 100 is sided by a side plate 101.

In an operation of the winder, a plurality of spool assemblies 100 are fed into the body 300 through the inlet opening of the channel 301 in order, using a separate spool feeding means (not shown), the assemblies 100 roll down on the inclined bottom wall of the channel 301 in a direction toward the spool seat 201 of the bobbin lift 200. In such a case, only a leading assembly 100 reaches the seat 201 prior to being seated on that seat 201, with the remaining assemblies 100 temporarily held on the inclined bottom wall of the channel 301 at standby positions by the stoppers 303 as shown in FIG. 2*b*.

When the leading assembly 100 is completely seated on the spool seat 201, the lead screw 202 is rotated. The bobbin lift 200, engaging with the lead screw 202, is thus raised up along with the spool assembly 100, thus discharging the assembly 100 from the body 300 to a designated position above the spool outlet opening 302.

When the spool assembly 100 is completely discharged from the body 300 to the designated position above the spool outlet opening 302, the two cylinders 402 and 403 of the head and tail stocks 401 and 400 move toward each other as shown in FIG. 2*c*.

The two cylinders 402 and 403, having a conical shape, are respectively inserted into the central bores of both side plates 101 of the assembly 100, thus holding the assembly 100.

When the spool assembly 100 completely engages with the two cylinders 402 and 403 at both side plates 101 as described above, the assembly 100 is slightly lifted up from the primarily designated position to a final set position due to the tapered surface of the conical cylinders 402 and 403. The lead screw 202 is rotated in an inverse direction simultaneously with the set-positioning of the assembly 100, thus lowering the bobbin lift 200 to its original position within the body 300.

After setting the spool assembly 100 at the final set position between the two stocks 401 and 400, a drive motor (not shown) rotates the cylinder 403 of the tail stock 400, thus rotating the spool assembly 100 at a speed in a desired direction.

When the spool assembly 100 is rotated as described above, the guide roller 501 guides a steel cord 500 from a braiding machine (not shown) while reciprocating within a range limited by a spool of the assembly 100 with the leading end of the cord 500 being fixed to the end portion of the assembly 100 as shown in FIG. 2*d*. The steel cord 500 is thus evenly wound around the spool of the assembly 100. When the steel cord 500 is completely wound around the spool of the assembly 100, the guide roller 501 leads the steel wire 500 to a next spool of the assembly 100 prior to repeating the above-mentioned reciprocating action, thus allowing the steel cord 500 to be evenly wound around the next spool. Such a cord winding operation of the winder is continued until the steel cord 500 is completely wound around all the spools of the assembly 100.

After the steel cord 500 is completely wound around all the spools of the assembly 100, the rotating speed of the assembly 100 is reduced. In such a case, the guide roller 501 returns to its original position prior to winding a surplus steel cord 500 around a guide groove, formed at a position around the side plate 101, at about two turns.

Thereafter, the cord cutter 600 moves in a direction toward the steel cord 500 by a moving means 602 as shown in FIG. 2*e*, thus allowing the steel cord 500 to be brought into contact with the electrode bar 601. The electrode bar 601 is, thereafter, turned on with the steel cord 500 coming into contact with the bar 601, thus thermally melting the steel cord 500 to cut the cord 500.

After the steel cord 500 is completely cut by the cutter 600, the bobbin lift 200 is raised upwardly so as to support the bottom of the spool assembly 100. The two cylinders 402 and 403 of the head and tail stocks 401 and 400, thereafter, return to their original positions. Both side plates 101 of the spool assembly 100 are thus released from the two cylinders 402 and 403.

When the spool assembly 100 is released from the cylinders 402 and 403 of the two stocks 401 and 400, the assembly 100 rolls over the spool seat 201 of the bobbin lift 200 prior to rolling down on the top wall of the body 300 to a separate dispensing means (not shown) under the force of gravity as shown in FIG. 2*f*. Thereafter, the bobbin lift 200 is lowered to its original position so as to seat a next spool assembly 100 on the spool seat 201. When the next spool assembly 100 is completely seated on the spool seat 201, the bobbin lift 200 is raised upward so as to discharge the assembly 100 to the designated position above the opening 302.

The above-mentioned process is repeated during a steel cord winding operation of the winder.

As described above, the present invention provides an automatic cord winder for steel cord braiding machines. The winder of this invention is designed to automatically and continuously drive a spool assembly, consisting of a plurality of spools, while feeding the spool assembly into a winder body, moving the spool assembly to a designated position between the head and tail stocks on the winder body, installing the spool assembly at the designated position, sequentially winding the steel cord around the spools of the assembly, and dispensing the spool assembly from the winder body when the spools of the assembly are filled with the steel cord. Therefore, the winder of this invention does not need a worker to stand in the vicinity of the winder during an operation of the winder. This conserves labor and improves productivity while producing and winding the steel cords.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic steel cord winder, comprising:

a spool assembly consisting of a plurality of spools, said spools being assembled together into a longitudinal single assembly with both an intermediate plate interposed at each junction between said spools and a side plate siding each end of said spool assembly, said spool assembly being used for winding a steel cord on the spools;

a winder body having both a spool inlet channel and a spool outlet opening, said spool inlet channel extending from a spool inlet opening, formed on a front wall of the body, to an interior position of the body and adapted for allowing the spool assembly to be fed from the spool inlet opening into the interior position of the body, said spool outlet opening being formed on a top wall of the body and adapted for allowing the spool assembly to be discharged upwardly from the interior position of the body to a designated position above the top wall of said body;

a bobbin lift movably set in said winder body and selectively raised upwardly along with the spool assembly from the interior position of the body by a lead screw, thus discharging the spool assembly from the body to the designated position above the top wall of the body through the spool outlet opening;

head and tail stocks respectively positioned on the top wall of said winder body at positions around both edges of the spool outlet opening, each of said stocks having a movable cylinder, said cylinder selectively engaging with each side plate of the spool assembly, placed on the designated position above the spool outlet opening, and rotating the spool assembly while holding the assembly; and a cord cutter adapted for melting the steel cord to cut the cord using an electrode bar, with the cord completely wound around the spools of the spool assembly under the guide of a reciprocating guide roller.

2. The automatic steel cord winder according to claim 1, wherein a bottom wall of said spool inlet channel is inclined downwardly in a direction from the spool inlet opening to a spool seat, thus allowing the spool assembly to roll down on the bottom wall of the channel from the spool inlet opening prior to being seated on the spool seat.

3. The automatic steel cord winder according to claim 1, wherein both the spool inlet opening and the spool outlet opening of said winder body have a rectangular profile suitable for allowing the longitudinal spool assembly to be fed into and discharged from the body while retaining its horizontal position.

4. The automatic steel cord winder according to claim 1, wherein a stopper is provided on a bottom wall of said spool inlet channel for temporarily holding the spool assembly at a standby position before the spool assembly reaches the spool seat.

* * * * *